US006536803B2

(12) United States Patent
Masson

(10) Patent No.: US 6,536,803 B2
(45) Date of Patent: Mar. 25, 2003

(54) FOLDER

(75) Inventor: Dave Masson, Aberdeen (GB)

(73) Assignee: Sofos Partnership Limited, Aberdeen (GB)

( * ) Notice: Subject to any disclaimer, the term of this patent is extended or adjusted under 35 U.S.C. 154(b) by 0 days.

(21) Appl. No.: 09/923,411

(22) Filed: Aug. 8, 2001

(65) Prior Publication Data

US 2002/0025216 A1 Feb. 28, 2002

(30) Foreign Application Priority Data

Aug. 16, 2000 (GB) ..... 0020050

(51) Int. Cl.[7] ..... A47B 23/00

(52) U.S. Cl. ..... 281/33; 281/37; 248/444.1; 248/460

(58) Field of Search ..... 281/33, 36, 37, 281/21.1, 45; 402/70, 73; 248/462, 463, 457, 444.1, 460

(56) References Cited

U.S. PATENT DOCUMENTS

| | | | | |
|---|---|---|---|---|
| 1,728,430 A | * | 9/1929 | Mevi | 281/33 |
| 1,957,039 A | * | 5/1934 | Buenger et al. | 281/33 |
| 3,195,925 A | * | 7/1965 | Walker, Jr. | 281/33 |
| 3,224,792 A | * | 12/1965 | Vernon | 281/33 |
| 4,377,271 A | * | 3/1983 | Smith | 281/33 X |

* cited by examiner

*Primary Examiner*—Willmon Fridie, Jr.
(74) *Attorney, Agent, or Firm*—Fleshner & Kim, LLP

(57) ABSTRACT

A folder (1) is provided which may be used to aid in document management and in the giving of formal presentations. The folder (1) is provided with an integral stand mechanism (25) for supporting the folder in an upright position, with the stand mechanism being moveable between a retracted position and a deployed position. The folder may also include other novel features, including a timepiece (23) and detachable wallets (11, 19) or papers that permit a user to configure the presentation folder in their preferred arrangement.

13 Claims, 3 Drawing Sheets

FOLDER

BACKGROUND OF THE INVENTION

The present invention relates to the field of containing and carrying of documents. In particular it discloses a folder used for example to aid in document management and in the giving of formal presentations before an audience.

Folders are used as a means of containing and carrying documents within an office or between meetings. These are generally of a standard A4 size comprising of two sections separated by central vertical fold. It is known that at least one portion may contain a pocket or wallet to contain relevant literature, business cards, etc. Often a holding means is incorporated such that a pen may be secured within the folder. Transparent cover sheets or envelopes may also be incorporated to permit the reading of papers without removing them from the folder. These cover sheets or envelopes also act to keep the contained document clean and in good physical condition. When required to give a presentation to an audience, a lectern is often used by a speaker. This provides a stand on which the folder can be placed so as to be in a convenient position for the speaker to refer.

OBJECTS AND SUMMARY OF THE INVENTION

However, lecterns and similar supports are not always available and it is an object of the present invention to provide a presentation folder for carrying documents that employs an inherent stand mechanism that is easily deployable.

It is a further object of the present invention to provide a presentation folder for carrying documents that employs a timepiece for monitoring the time or the timing of a meeting or presentation.

It is a yet further object of the present invention to provide a presentation folder for carrying documents that employs detachable elements that allow the folder to be configured to the preference of a specific user.

The present invention provides a folder for carrying documents that comprises a stand mechanism for supporting the folder, wherein the stand mechanism is moveable between an initial retracted position and a second deployed position.

Preferably the folder comprises two or more units separated by folding spines, wherein the folder opens by unfolding the units relative to each other.

Preferably when the folder is closed it is secured by a fastening means.

Preferably the fastening means is one or more press stud fasteners.

Alternatively the fastening means is one or more Velcro strips.

Preferably the stand mechanism comprises a sloping section, a base section, a plurality of living hinges and means for securing the stand mechanism in position, such that securing means act to secure the bottom of the base section and the top of the sloping section to a folder unit.

Preferably when the stand mechanism is in its initial retracted position the sloping section and base section both lie parallel to the folder unit and when moved to the second deployed position the living hinges cause the base unit and sloping section to extend outwards from the folder unit thus forming a support structure for the folder.

Preferably the means for securing the stand mechanism are press stud fasteners.

Alternatively the means for securing the stand mechanism are Velcro strips.

The present invention provides a folder for carrying documents that comprises a plurality of detachable wallets and papers that permit the user to configure the presentation folder to their preferred arrangement.

Preferably the means for securing the wallets to the presentation folder are press stud fasteners.

Alternatively the means for securing the wallets to the presentation folder are Velcro strips.

Preferably the means for securing the papers to the presentation folder are ring bindings.

The present invention provides a folder for carrying documents that comprises a timepiece.

Preferably the timepiece is an inherent component of a folder unit.

Alternatively the timepiece is an inherent component of a detachable wallet element.

BRIEF DESCRIPTION OF THE DRAWINGS

An embodiment of the present invention will now be described by way of example only, with reference to the accompanying drawings in which.

DETAILED DESCRIPTION OF PREFERRED EMBODIMENTS

Figure 1:
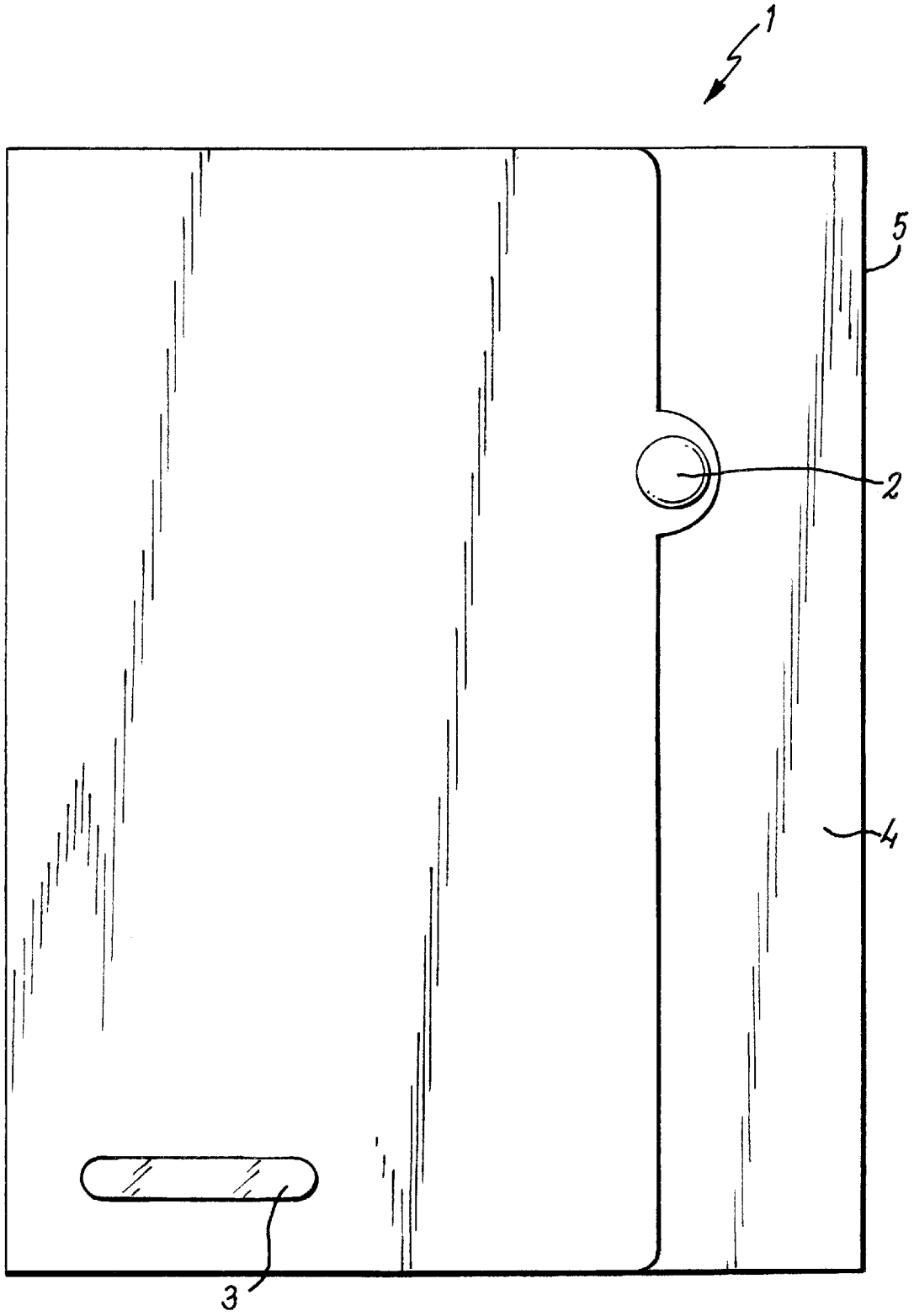
FIG. 1 illustrates a front elevation of a folder in a closed position.

Referring initially to FIG. 1, a folder 1 is depicted in its closed position. The folder 1 is held in this closed position by a press stud fastener 2. A metal badge 3 and an advertisement area 4 are also incorporated on the closed front face 5 of the folder.

Figure 2:
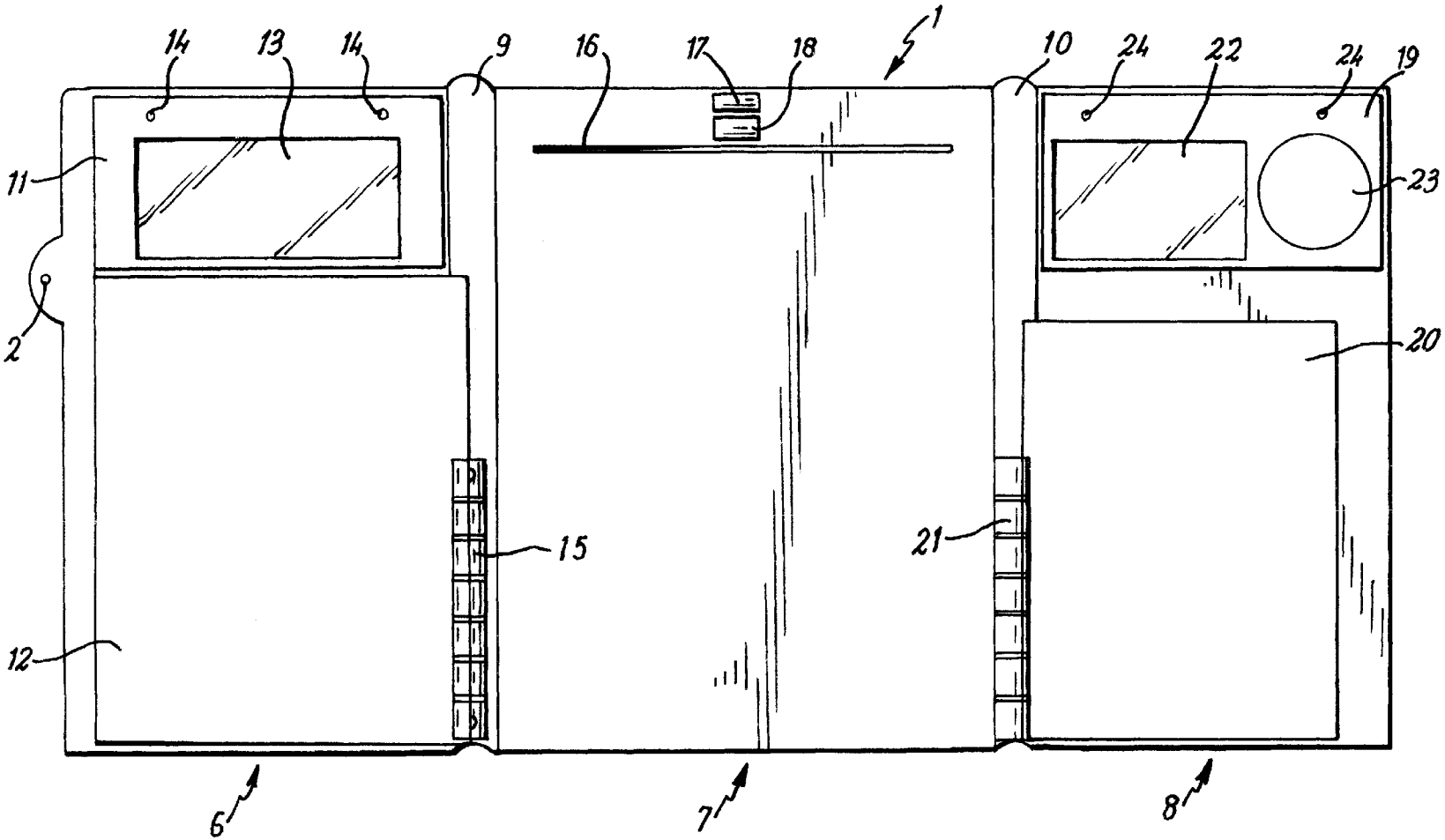
FIG. 2 illustrates a front elevation of the open folder of FIG. 1.

FIG. 2 illustrates the folder 1 in its open position. The folder 1 can be seen to comprise of three main sections; a left-hand unit 6, a central unit 7 and a right-hand unit 8. These three units are separated by folding spines 9 and 10.

The left-hand unit 6 is merely the inside surface of the front face 5 of the closed folder 1. It comprises a detachable pocket 11 and a card set 12. The detachable pocket 11 further comprises a window 13 and it is secured in place by press stud fasteners 14. The card set 12 is secured in place by a ring binding means 15 located on the folding spine 9.

The central unit 7 comprises a notepad locating slot 16, a small pen loop 17 and a large pen loop 18. The notepad locating slot 16 is employed to fix a notepad to the central unit 7 of the folder 1.

The right-hand unit 8 is similar in design to the left-hand unit 6, in that it comprises a detachable pocket 19 and a reference booklet 20. The reference booklet 20 is secured in place by ring binding means 21 located on the folding spine 10. The detachable pocket 19 further comprises a window 22 and a timepiece 23 and is secured in place by press stud fasteners 24.

Figure 3:
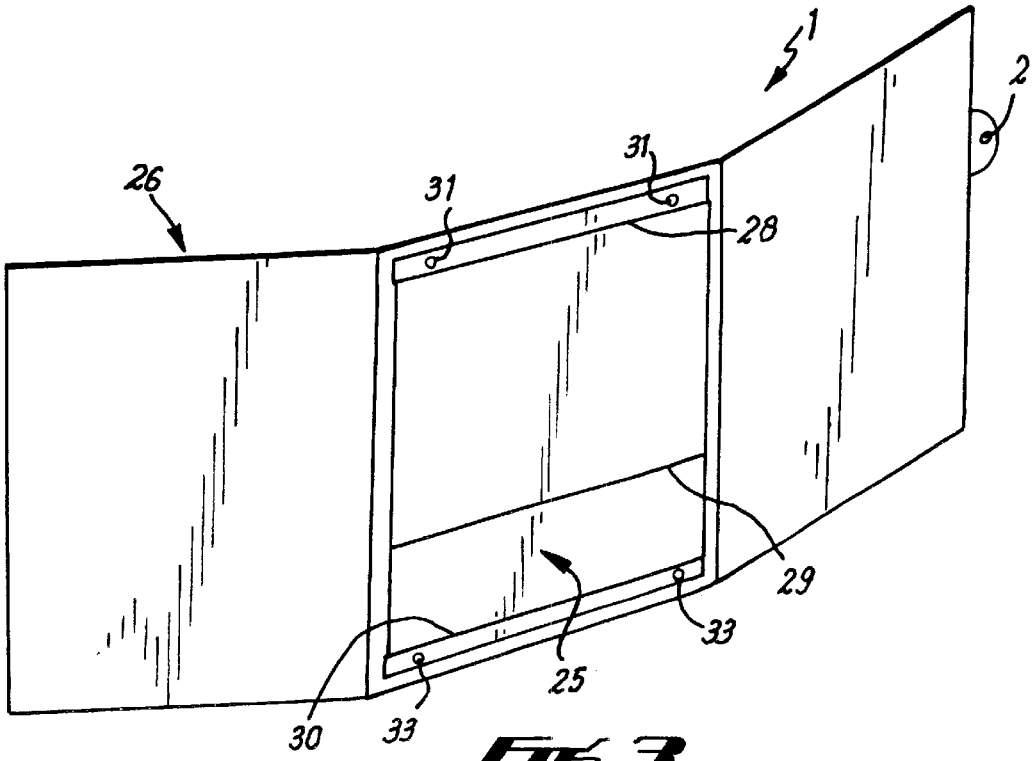
FIG. 3 illustrates a retracted stand mechanism employed by the open folder of FIG. 1.
Figure 4:
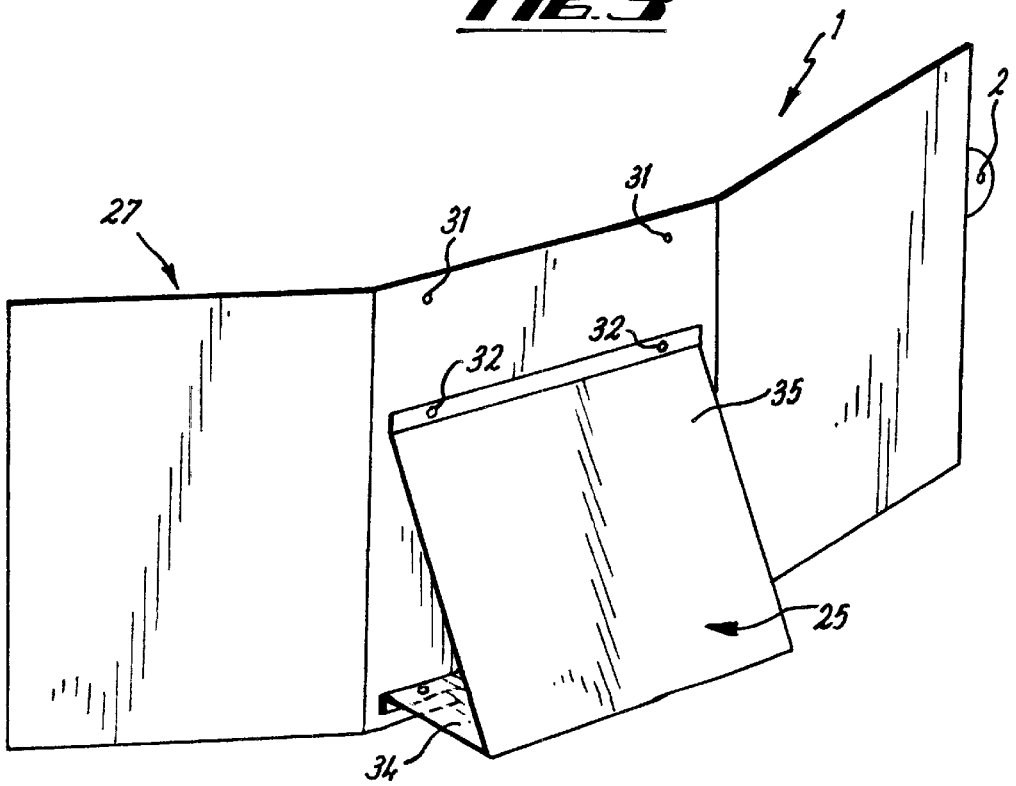
FIG. 4 illustrates a deployed stand mechanism employed by the open folder of FIG. 1.

FIG. 3 illustrates a stand mechanism 25 located on the rear of the central unit 7. The stand mechanism moves from a retracted position 26 as shown in FIG. 3 to a deployed position 27 as shown in FIG. 4. The stand mechanism incorporates three living hinges 28, 29 and 30 and three sets of press stud fasteners 31,32 and 33. When the stand mechanism 25 is in a retracted position 26 it is secured to the central unit 7 by the press stud fasteners 31 and 33. The stand mechanism 25 then lies flat against the central unit 7.

By unfastening the stand mechanism 25 from the press stud fasteners 31, it can be moved to the deployed position 26 and secured in place by the second press stud fasteners 32. At this stage the living hinges 28, 29 and 30 cause the stand mechanism 25 to fold into two distinct sections; a base section 34 and a sloping section 35.

A person may be required to provide a presentation to an audience for a wide range of reasons, this might be by way of a presentation in the course of their business or as part of providing a training or higher educational course. The folder 1 is a highly useful aid for such presentations. Information regarding the presentation is easily carried within the folder 1 on arrival the folder 1 is opened and by employing the stand mechanism 25 can be set up upon any flat surface, thus removing the requirement for a lectern. Many presentations are given under time constraints, therefore the incorporation of the timepiece 23 allows the speaker to easily monitor the timing of their presentation.

The folder 1 may also be readily used by an audience to take notes. The speaker may hand out to the audience the folder 1 providing them with business information, relevant literature, pens and paper as relevant. The incorporation of the medal badge 3 and the advertisement area 4 allows the presentation folder to actively promote the speaker's business.

The folder 1 incorporates two detachable pockets 11 and 19, secured by press stud fasteners 14 and 24 respectively. These detachable pockets may incorporate small notepads, business cards, etc. The card set 12 and reference booklet 20 are held in place by ring binding means 15 and 21 respectively. With this configuration, the folder 1 is extremely flexible in its set up, allowing the user to arrange the elements in their preferred configuration. This proves particularly useful for interchanging between left and right handed users.

The advantage of the present invention is that it provides a compact and convenient means for the carriage of a presentation or relevant business literature that can be easily deployed by a user by employing an inherent stand mechanism.

A further advantage of the present invention is that it incorporates a timepiece that allows the monitoring of the time of a meeting or a presentation.

A yet further advantage of the present invention is that its flexible configuration allows each user to arrange the elements to their preferred orientation.

Further modifications and improvements may be added without departing from the scope of the invention herein intended.

What is claimed is:

1. A three-sided folder for carrying documents, the folder comprising:

a left-hand unit;

a right-hand unit;

a central unit, wherein the central unit is separated from the right-hand unit by a first folding spine, and is separated from the left hand unit by a second folding spine; and a stand mechanism located on the central unit of the folder and moveable between a retracted non-deployed position and an extended deployed position, wherein the stand mechanism comprises a sloping section, a base section, a plurality of living hinges and means for securing the stand mechanism in the retracted non-deployed position or the extended deployed position.

2. A folder as claimed in claim 1, wherein the folder is opened by unfolding the units relative to each other.

3. A folder as claimed in claim 1, wherein when the means for securing the stand mechanism in the retracted non-deployed position or the extended deployed position comprises press stud fasteners.

4. A folder as claimed in claim 1, further comprising a timepiece.

5. A folder as claimed in claim 1, comprising a plurality of detachable wallets and papers that permit a user to configure the presentation folder to their preferred arrangement.

6. A folder as claimed in claim 1, wherein the securing means secures the sloped section and the base section of the stand mechanism to the central unit of the folder.

7. A folder as claimed in claim 1, wherein when the stand mechanism is in the retracted non-deployed position, the sloped section and the base section of the stand mechanism are substantially parallel to the central unit of the folder.

8. A folder as claimed in claim 1, wherein when the stand mechanism is in the extended deployed position, the sloped section and the base section of the stand mechanism are extended away from the central unit of the folder using the living hinges to create a support for the folder.

9. A folder for carrying documents, comprising:

a plurality of substantially rigid sections, wherein each section is joined to another of the plurality of sections by a folding spine; and a stand mechanism located on a central one of the plurality of substantially rigid sections, wherein the stand mechanism is configured to support the folder, wherein the stand mechanism comprises:

a sloping section, a base section, a plurality of living hinges attached to the sloping section and the base section, and means for securing the stand mechanism in a retracted non-deployed position and in an extended deployed position.

10. A folder as claimed in claim 9, wherein the stand mechanism is configured such that when the stand mechanism is in the retracted non-deployed position, the sloping section and the base section both lie substantially parallel to one of the plurality of substantially rigid sections, and wherein when the stand mechanism is in the extended deployed position, the sloping section and the base section are extended outwards from one of the plurality of substantially rigid sections to form a support structure for the folder.

11. A folder as claimed in claim 9, wherein the plurality of substantially rigid sections comprise:

a left-hand section;

a right-hand section; and a central section, wherein the stand mechanism is attached to the central section.

12. A folder as claimed in claim 11, wherein the securing means is configured to attach the sloping section to at least two different locations on the central section.

13. A folder as claimed in claim 9, wherein the securing means comprises fasteners.

* * * * *